United States Patent [19]

Westdale et al.

[11] Patent Number: 4,514,077

[45] Date of Patent: Apr. 30, 1985

[54] MAGNETIC TONER DEVELOPING DEVICE

[75] Inventors: Virgil W. Westdale, Barrington; James L. Hanrahan, Mt. Prospect; William C. Anderson, McHenry, all of Ill.

[73] Assignee: AM International, Inc., Chicago, Ill.

[21] Appl. No.: 467,781

[22] Filed: Feb. 18, 1983

[51] Int. Cl.[3] ..... G03G 15/09

[52] U.S. Cl. ..... 355/3 DD; 118/658; 355/3 R

[58] Field of Search ..... 355/3 R, 3 DD; 118/653, 118/656, 657, 658, 661

[56] References Cited

U.S. PATENT DOCUMENTS 3,907,423 9/1975 Hayashi et al. ..... 355/10
3,990,793 11/1976 Anzai et al. ..... 355/10
4,088,402 5/1978 Rudd et al. ..... 355/3 DD
4,235,549 11/1980 Eisbein et al. ..... 355/3 DD

*Primary Examiner*—Fred L. Braun
*Attorney, Agent, or Firm*—Nicholas A. Camasto

[57] ABSTRACT

A magnetic toner developing device for developing images on a photoconductive sheet. The device includes a magnetic developer roller brush for applying a single component toner to the sheet. An electrically isolated guide plate extends beneath the developer roller brush in close proximity thereto and supports the sheet in its travel through a development zone formed between the developer roller brush and the guide plate. The guide plate is electrically isolated from a support frame to eliminate electrostatic clamping of the sheet to the guide plate.

4 Claims, 4 Drawing Figures

MAGNETIC TONER DEVELOPING DEVICE

BACKGROUND OF THE INVENTION AND PRIOR ART

This invention relates to a magnetic toner developing device utilizing a single component toner for developing images on a photoconductive sheet master. More particularly, it concerns an electrically isolated guide for supporting a sheet master during development to minimize the clamping effect on the sheet, caused by the electrostatic field between the developer brush and the guide, and to permit uniform advancement of the sheet through a development zone.

In the lithographic printing and duplicating field various types of planographic printing plates or masters are used for reproducing duplicated copies. Some masters receive a direct image from a typewriter or the like, while others have a sensitized surface for receiving a photographic image and still others have a photoconductive surface for receiving an electrostatic image. Conventionally, a photoconductive master sheet is uniformly charged by a corona charging means and exposed to a document to be copied via an optical projection system to produce an electrostatic latent image on its surface. The latent image is subsequently developed with a magnetic toner to produce a visible image. The master may then be treated with a conversion solution to provide a lithographic surface for producing offset lithographic copies, all in a conventional manner.

In the development of the latent images on the sheet masters, in two-component systems a "soft" developer brush is used and the charged master passed over its periphery. No backup plate is required. In single component toner systems, there is no triboelectric charge between the toner particles and a "thin" developer brush is required, with close spacing and tolerances being used in the development zone. Thus a guide plate is used to support the charged master which is passed under the developer brush. The terms soft and thin are of course relative. In the single component system the developer brush has on the order of one sixty fourth to one eighth inch of toner, whereas in the conventional two component system it is one quarter inch or more. With the single component magnetic toner, difficulty has been experienced in advancing the sheets through the developing station in the smooth, uniform and continuous manner needed for the production of high quality imaged sheets.

The single component developing station includes a magnetic developer brush of conventional construction, but of rigid configuration for applying toner to the sheet and a grounded metallic guide for supporting the sheet in its travel through the developing station. In a photoconductive master system, the latent image results in the insulated photoconductor sheet being charged. The charged photoconductive sheets tend to "hang-up" due to the clamping effect of the capacitor formed by the charged photoconductive layer as one plate, the insulated base sheet as the dielectric, and the conductive guide, in contact with the other side of the sheet, as the other plate. This clamping effect, which seriously impairs movement of the sheet, is particularly pronounced when developing sheets with large, dense image areas i.e., sheets having a great deal of surface charge, especially in low relative humidity environments.

Because of the thinness of the sheet, the electric field is fairly strong and results in the above-mentioned clamping effect, especially in heavily charged areas.

Therefore, it is desirable and an object of the present invention to reduce and/or substantially eliminate the undesirable clamping effect created by a charged master sheet passing through a development zone.

SUMMARY OF THE INVENTION

In accordance with the invention a magnetic toner developing device for developing images on a charged sheet includes a magnetic developer roller brush, means supplying toner to the brush, guide means supporting the sheet during transit through a development zone and means for eliminating electrostatic clamping of said charged sheet to said guide means.

OBJECTS OF THE INVENTION

It is an object of the invention to provide an improved magnetic toner developing device.

Another object of the invention is to improve transport of a charged sheet through a development zone.

BRIEF DESCRIPTION OF THE DRAWINGS

Other objects, features and advantages of the invention will become apparent from reading the following description in conjunction with the drawings in which.

DESCRIPTION OF THE PREFERRED EMBODIMENT

Figure 1:
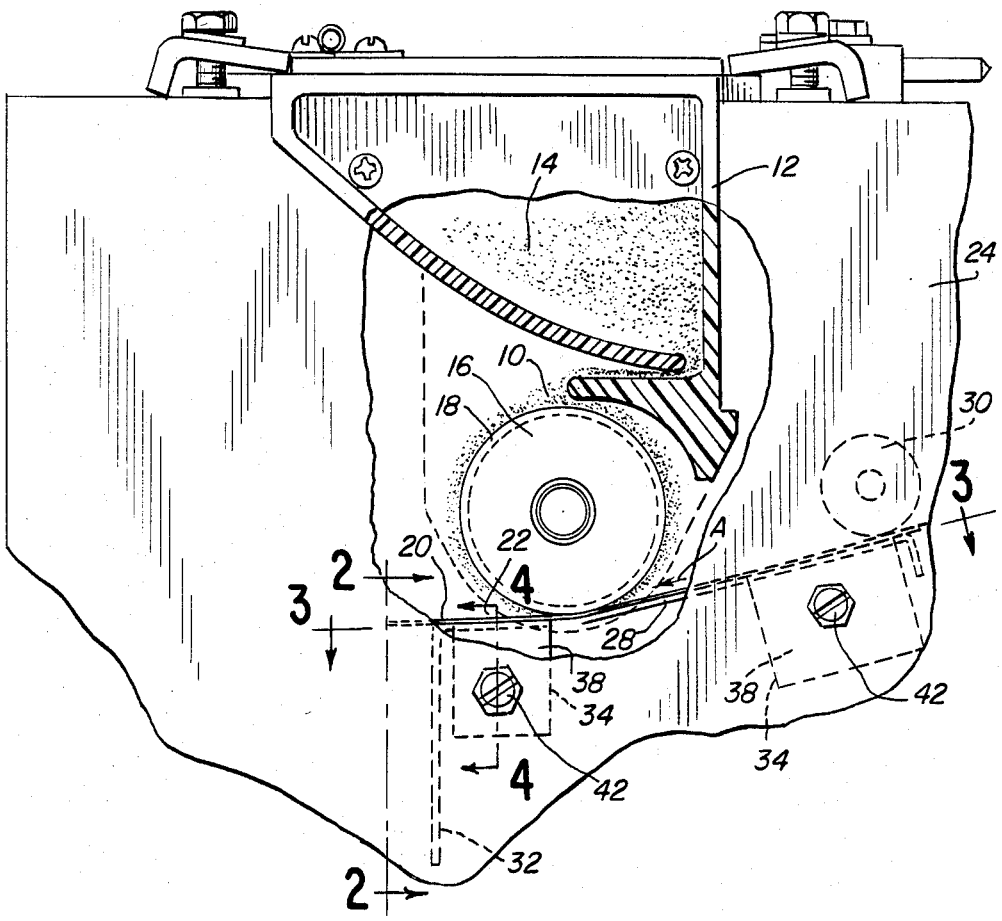
FIG. 1 is a schematic and elevation of a magnetic toner developing device incorporating the invention.

Referring to FIG. 1, a magnetic developer roller brush 10 has a magnetic single component toner 14 dispensed on its periphery from a toner supply 12. Brush 10 has a magnetic core 16 rotatable within a stationary outer sleeve 18. The magnetic field attracts the toner to the developer roller surface, thereby creating a brush-like periphery on sleeve 18 for delivering the toner to the charged face of a sheet master 20 as it is transported through a development zone 22. Roller brush 10 is mounted with its axis transverse to the direction of movement of the sheet (indicated by arrow A) through the development zone. Brush 10 and toner supply 12 are mounted in a pair of side plates 24 and 26 as best shown in FIGS. 2 and 3.

A guide 28 supports sheet master photoconductor 20 in its travel through development zone 22 and extends downwardly from a position adjacent a feed roller 30, in close proximity to the under-surface of developer brush 10, forming the development zone therebetween. The guide continues horizontally outwardly of the development zone and terminates in a downturned lip 32. Guide 28 also includes pairs of flanges 34 and 36, positioned in spaced apart relationship along each side 35 and 37, respectively, for mounting it between side plates 24 and 26. In accordance with one aspect of the invention, guide 28 may be constructed of any suitable nonmagnetic material such as anodized aluminum or stainless steel. In accordance with another aspect of the invention, the guide may be constructed of insulated material.

In the preferred construction illustrated, guide 28 is supported in an electrically isolated manner to minimize the clamping due to electrical charge on the photo conductive surface of the sheet, the sheet itself, and the conductive guide. However, both electrical isolating and electrical insulating methods are contemplated. Thus while the preferred embodiment illustrates a conductive guide 28 insulated from side plates 24 and 26 by nonconductive barriers and screws, it is also contemplated that the guide may be made of nonconductive material, or may include a sufficiently thick layer of insulating material on a conductive base to accomplish its purpose of nullifying the electrostatic clamping effect.

Figure 4:
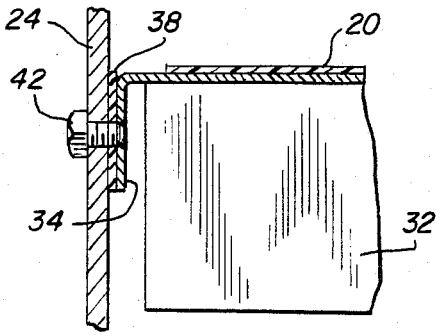
FIG. 4 is a fragmentary sectional view taken along line 4—4.
Figure 2:
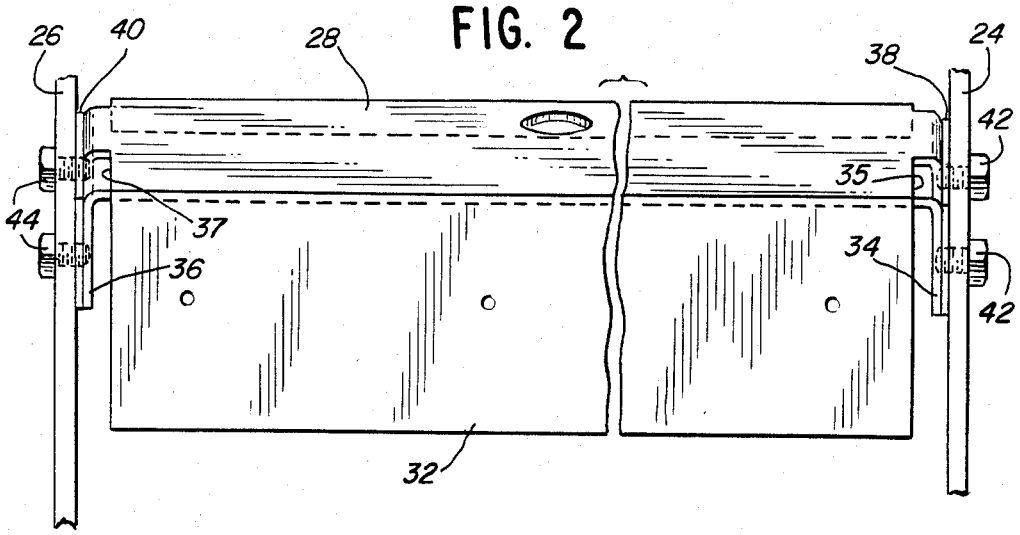
FIG. 2 is a front elevation as taken along line 2—2, with portions omitted for clarity.
Figure 3:
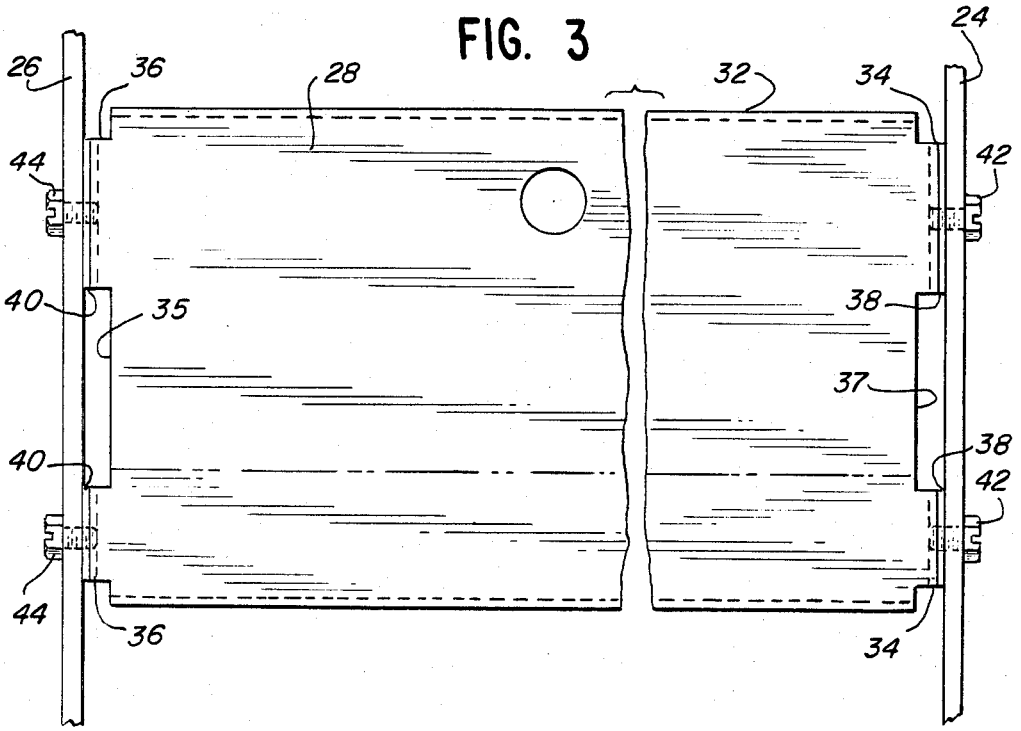
FIG. 3 is a plan view taken along line 3—3.

As shown in FIGS. 2, 3 and 4, the barrier is a thin strip or film of insulating material 38 positioned between each of flanges 34 and side plate 24, and a corresponding strip or film of insulating material 40 positioned between each of flanges 36 and side plate 26. Guide 28 is secured to the side plates with electrically nonconductive fasteners 42 and 44 threaded into flanges 34 and 36, respectively. Various materials may be used for the barriers to isolate the guide. Strips of plastic film and plastic fasteners have been found to be effective for isolation. The guide may also be insulated to the same end of eliminating the clamping effect on sheet 20 and facilitating its smooth transit through the development zone.

With the invention, the charged sheet masters are uniformly advanced through the development zone - even in the presence of areas of high charge and a dry environment.

What is claimed is:

1. A magnetic toner developing device for developing an image on a charged sheet during transport of the sheet through a development zone comprising:

a support frame;

a magnetic developer roller brush for applying a single component toner to the sheet;

means for supplying a relatively thin layer of said single component toner to the developer roller brush;

a guide plate extending beneath the developer roller brush in close proximity thereto for supporting the sheet in its transport through the development zone formed between the developer roller brush and the guide plate; and means for electrically isolating said guide plate from said support frame to eliminate electrostatic clamping of said charged sheet to said guide plate.

2. A device as set forth in claim 1 wherein said guide plate includes a pair of flanges coupled to said support frame, and means for electrically insulating said flanges from said support frame.

3. A device as set forth in claim 2 in which said insulating means comprise thin plastic barriers interposed between said flange and said support frame.

4. A device as set forth in claim 1 wherein said guide plate comprises a nonconductive guide member.

* * * * *